United States Patent [19]

Majerus

[11] 4,359,943

[45] Nov. 23, 1982

[54] SHAPED CHARGE WARHEAD INCLUDING SHOCK WAVE FORMING SURFACE

[75] Inventor: John N. Majerus, Rising Sun, Md.

[73] Assignee: The United States of America as represented by the Secretary of the Army, Washington, D.C.

[21] Appl. No.: 183,651

[22] Filed: Sep. 2, 1980

[51] Int. Cl.[3] ..... F42B 1/02

[52] U.S. Cl. ..... 102/309; 102/307

[58] Field of Search ..... 102/306, 307, 309

[56] References Cited

U.S. PATENT DOCUMENTS

| | | | |
|---|---|---|---|
| 3,103,882 | 9/1963 | Gilliland | 102/309 |
| 3,147,707 | 9/1964 | Caldwell | 102/309 |
| 3,621,916 | 11/1971 | Smith, Jr. | 102/306 X |
| 3,736,875 | 6/1973 | Bucklishch | 102/309 |
| 3,759,182 | 9/1973 | Levamaki et al. | 102/306 |
| 4,109,576 | 8/1978 | Eckels | 102/307 |
| 4,259,906 | 4/1981 | Krauch, Jr. et al. | 102/306 X |
| 4,291,624 | 9/1981 | Sabranski | 102/307 |
| 4,300,453 | 11/1981 | Bigler | 102/309 X |

*Primary Examiner*—Peter A. Nelson

*Attorney, Agent, or Firm*—Nathan Edelberg; Robert P. Gibson; A. Victor Erkkila

[57] ABSTRACT

A shock-wave-reflecting surface and low density matter or gas within the frontal ogive of a shaped charge warhead ahead of the concave liner thereof modifies the speed and consequent distribution of particles in the stretching jet to improve armor penetration capability.

14 Claims, 7 Drawing Figures

SHAPED CHARGE WARHEAD INCLUDING SHOCK WAVE FORMING SURFACE

GOVERNMENT INTEREST

The invention described herein may be manufactured, used and licensed by or for the Government for governmental purposes without the payment to me of any royalties thereon.

BACKGROUND OF THE INVENTION

The present invention relates to shaped charge warheads and, in particular, to methods for controlling the shape and/or velocity distribution of particles in a jet produced by a collapsing liner in a shaped charge warhead.

In the prior art, for example, in U.S. Pat. Nos. 2,972,948 and 3,661,086, shaped charge warheads have been disclosed in which a forward facing cavity with a liner of suitable material is employed to enhance the armor piercing effectiveness of a given quantity of explosive. The explosive collapses the liner and projects particles thereof forward in a sharply focused hypervelocity jet having greatly enhanced armor piercing capability.

A number of factors are believed by the applicant to be influential in producing and controlling such a jet and thereby affecting its effectiveness. Such factors may include along or in combination the shape and type of explosive, the presence, location, material and geometry of a wave shaper in the explosive material, the material, thickness and shape of a casing containing the explosive, and the shape, axial variation of thickness and material in the liner.

The selection of specific values for the above factors depends upon the characteristics desired in the jet, such as, for example, the velocity at the front and rear of the jet, its diameter, distribution of velocity along its length and the time required for the jet to break up from a continuous state into a series of axially aligned particles. However, it is not always possible to optimally combine all of the above parameters to produce a jet having the desired characteristics. In addition, many of the parameters are limited by practical considerations such as availability and cost of materials, the ability and/or cost to fabricate a specific design and the total weight and/or length of the shaped charge warhead.

In addition, it may be desirable to modify the characteristics of the jet of an existing shaped charge warhead so that additional types of targets can be engaged with the same weapon system. In order to modify the jet characteristics using the above-named parameters, substantial modification of the shaped charge warhead is required, usually including removal of the explosive from the warhead. Such removal is extremely dangerous and greatly restricts the number of facilities which are capable of doing such retrofitting.

OBJECTS AND SUMMARY OF THE INVENTION

Accordingly, it is an object of the present invention to provide a shaped charge warhead which overcomes the drawbacks of the prior art.

It is a further object of the present invention to provide a shaped charge warhead which permits modification of the jet of hypervelocity metallic particles.

It is a further object of the present invention to provide a method and means for modifying the characteristics of the hypervelocity jet of metallic particles in a manner which does not require removal of an explosive from the warhead.

It is a further object of the present invention to modify the characteristics of the jet of hypervelocity metallic particles by modifying an internal shape in a frontal ogive to produce a reflected shock interaction with the jet, such reflected shock interaction being effective to modify the velocity distribution of particles in the jet.

According to an aspect of the invention, there is provided a shaped charge warhead of the type having a concave cavity in front of an explosive for producing a jet of rapidly forward-moving particles preceded by a shock wave and a frontal ogive enclosing the cavity, comprising at least one shaped surface in the frontal ogive forward of the cavity dividing the frontal ogive into an inner region and an outer region, the shaped surface having a central opening therein communicating the inner and outer regions, and the shape of the surface and the location and size of the opening being effective to produce a reflected shock which interacts with the jet to modify at least one characteristic of the jet.

According to another aspect of the invention, there is provided a shaped charge warhead comprising a casing, a generally conical metallic liner closing a forward end of the casing, the liner forming an axially symmetric concave cavity in the forward end of the casing, an explosive in the casing, means for detonating the explosive at the rear end thereof, a frontal ogive enclosing the forward end of the shaped charge warhead, a shock-wave-forming surface in the frontal ogive dividing the volume in the frontal ogive into an inner region between the surface and the liner and an outer region between the surface and the inside of the frontal ogive, an axially symmetrical hole in the surface communicating the inner and outer regions, the warhead being effective when detonated to collapse the liner into a high-speed jet of particles which pass through the hole preceded by a shock wave, and the shock-wave-forming surface being effective to form a reflected shock which modifies at least one characteristic of the jet.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
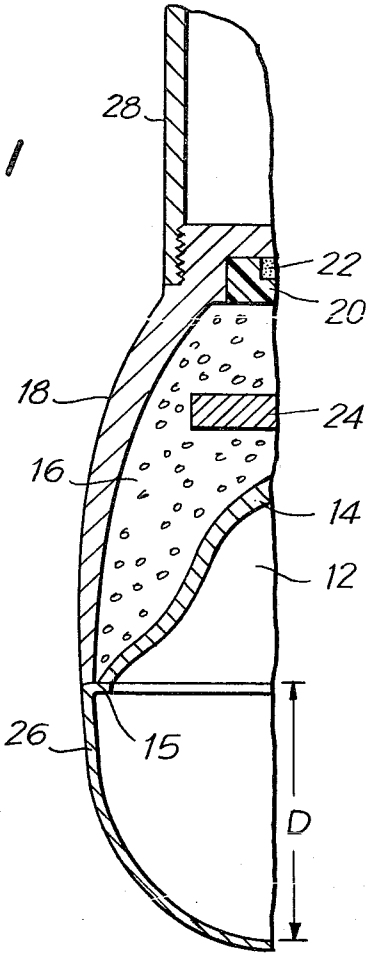
FIG. 1 is a cross section of a theoretical shaped charge warhead illustrating factors which may be sensitive parameters in the formation of a hypervelocity focused jet.

FIG. 1 is a drawing of a theoretical shaped charge warhead 10 in which each element which the inventor believes may be a sensitive parameter in armor penetration capability is shown exaggerated for clarity. It should be understood that warhead 10 and its description does not represent a statement of the known prior art but is merely a schematic representation of those elements which may affect the performance of such a warhead. Shaped charge warhead 10, therefore, does not necessarily represent a combination which has ever appeared in a single weapon, but is presented for purposes of pointing out variables which the applicant believes may affect the armor penetration capability.

In general, the armor penetrating capability of shaped charge 10 is derived from a shaped cavity 12 in its front. The concavity is typically lined with a metallic liner 14, preferably copper or steel and most preferably copper, but may include plastics, ceramics and combinations and alloys. Liner 14 includes a forward perimeter or base 15.

An explosive 16 is contained in a casing 18 behind liner 14. A booster 20 which may be detonated by a detonator 22 is centrally located at the rear of explosive 16. A wave shaper 24 within explosive 16 interferes with and shapes the detonation wave front so that, when the wave front reaches liner 14, it has the proper shape to collapse liner 14 into a focused jet of fast moving particles.

A frontal ogive 26 encloses the forward end of warhead 10 and extends a distance D ahead of base 15 of liner 14 to provide a forward aerodynamic enclosure as well as a built-in standoff distance. Frontal ogive 26 is conventionally included in a fusing arrangement (not shown) such as, for example, the fusing arrangement disclosed in U.S. Pat. No. 3,661,086. In this fashion, actuation of shaped charge warhead 10 is enabled to take place upon contact of frontal ogive 26 with a target and to thus provide a space or built-in standoff distance D required for the formation and projection of the high speed focused stream of metallic particles. Specifically, standoff distance D is on the order of 1 to 3 times the charge diameter (CD). For example, if the diameter of shaped charge warhead 10 is to 2 inches, standoff distance D is 2–6 inches. An aft aerodynamic enclosure 28 may also be included depending on the method of delivering the weapon.

It is believed that the performance of theoretical shaped charge warhead 10 is affected by the shape and thickness of casing 18 and, insofar as it affects strength, may be affected by the material from which casing 18 is fabricated. Conventionally, casing 18 is a simple uniform cylinder preferably of steel.

It is believed that the shape, thickness and material of liner 14 are sensitive parameters. Although a complex, roughly bell-shaped, interior and exterior contour having variable thickness from rim to apex is shown in FIG. 1, more conventionally, liner 14 is a simple right circular cone optionally with a truncated apex. In addition, liner 14 is usually of copper.

The shape of explosive 16 is normally determined by the inside shapes of casing 18 and liner 14. Thus, instead of the complex curved shape of explosive 16 shown in FIG. 1, when explosive 16 is formed in a cylindrical casing with a simple conical forward end, it conforms to this shape. Explosive 16 is normally cast as a flowable fluid which, after curing becomes a substantially solid mass. The aft end of cast explosive 16 may be machined in order to provide the proper shape to mate with booster 20.

Wave shaper 24 employs a dense material such as, for example, lead oxide, to retard or shape a portion of the wave front prior to impingement of the detonation wave front (not shown) on liner 14. The physical dimensions, material and shape of wave shaper 24 are believed to be sensitive parameters. Wave shaper 24 is an optional element which may be made unnecessary by proper shaping of casing 18, explosive 16 and liner 14.

Figure 2:
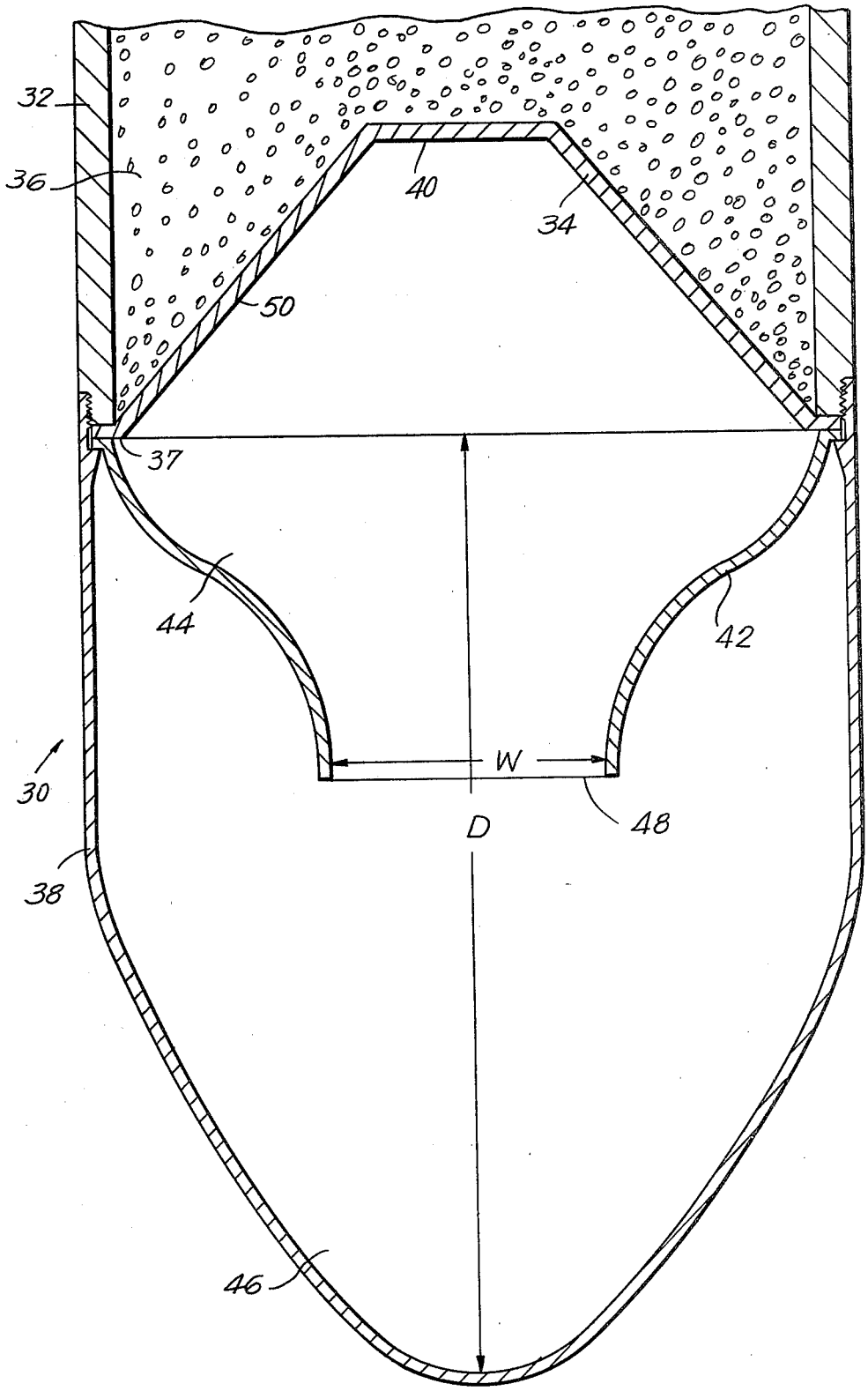
FIG. 2 is a cross section of a forward portion of a shaped charge warhead according to an embodiment of the invention prior to detonation of explosive material.

In addition to the parameters hereinabove discussed, the applicant has discovered an additional means for controlling and/or shaping the jet of metallic particles projected forward during detonation of the shaped charge warhead. Referring now to FIG. 2, a shaped charge warhead 30 which includes a generally cylindrical casing 32 and a truncated right conical liner 34 containing and defining an explosive 36 and having a base 37, has a frontal ogive 38 extending a distance D, suitably 1 to 3 charge diameters, forward of base 37.

A shock-wave-reflecting member 42, forward of liner 34, divides the volume within frontal ogive 38 into an inner region 44 between liner 34 and member 42 and an outer region 46 between member 42 and frontal ogive 38. Member 42 may have any convenient shape which is effective to reflect a shock wave of the required properties and is illustrated with a complex curve. Member 42 has an opening 48 of width W joining inner region 44 and outer region 46. Other shapes for shock-wave-reflecting member 42 may include a plane surface normal to the axis of shaped charge warhead 30 with an opening W therein or may have any other effective shape. Inner region 44 may be filled with air at atmospheric, elevated or reduced pressure, or may be filled with other low density gases or solids which may be used to enhance the formation and focusing of the reflected shock waves. For example, air, argon, nitrogen, rubber or plastic foams or high porosity metals, plastics or ceramics may be employed in inner region 44.

A thin layer of coating material 50 is coated on the forward surface of liner 34. Coating material 50 may be nothing more than the natural oxide coating on liner 34 but may also or alternatively include a thin metallic, ceramic or other material, preferably frangible and/or brittle, which may be blown off liner 34 by shock loading as liner 34 is collapsed to add particulate matter or vapor into inner region 44 to add to the density in that region and to thus aid in the rapid and controlled development of a shock wave.

A thin layer of coating material (not shown) may optionally be provided on the inner surface of shock-wave-reflecting member 42 contiguous to inner region 44. This layer may be the same as, or different from, coating material 50 and may be blown off the inner surface of shock-wave-reflecting member 42 upon impact by the generated bow shock so as to add further particulate matter or vapor to inner region 44.

Outer region 46 may be air filled or may contain other low-density material (not shown) of the same or different type from that contained in inner region 44.

Figure 3:
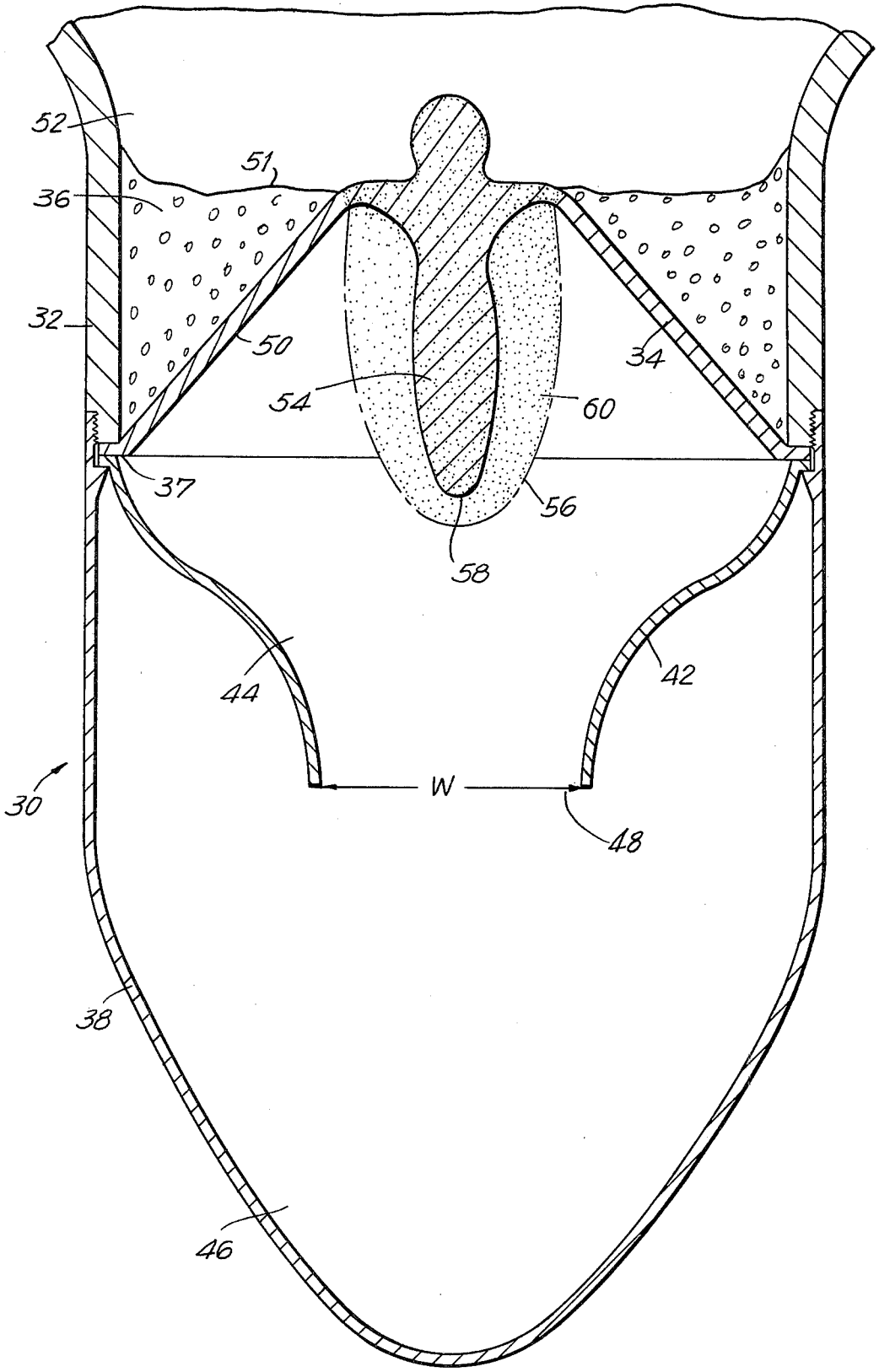
FIG. 3 is a cross section corresponding to FIG. 2 after detonation of the explosive and showing the beginning of jet formation.

Referring now to FIG. 3, there is shown a shaped charge warhead 30 shortly after detonation. An explosive wave front 51 has propagated through casing 36 producing confined gases 52 behind it with some yet-to-be consumed explosive 36 ahead of it. In the position shown, wave front 51 has passed the innermost extremity of liner 34 and has begun to form a jet 54 of fast moving metallic particles produced from the portion of liner 34 which has already been collapsed. A detached bow shock wave 56 advances at the velocity, of a tip 58 of jet 54, which ranges from about 2 to about 11 kilometers per second. A region 60 between shock wave 56 and jet 54 may contain heated air or gas combined with finely dispersed particles displaced from coating 50 from the collapsed areas of liner 34.

Figure 4:
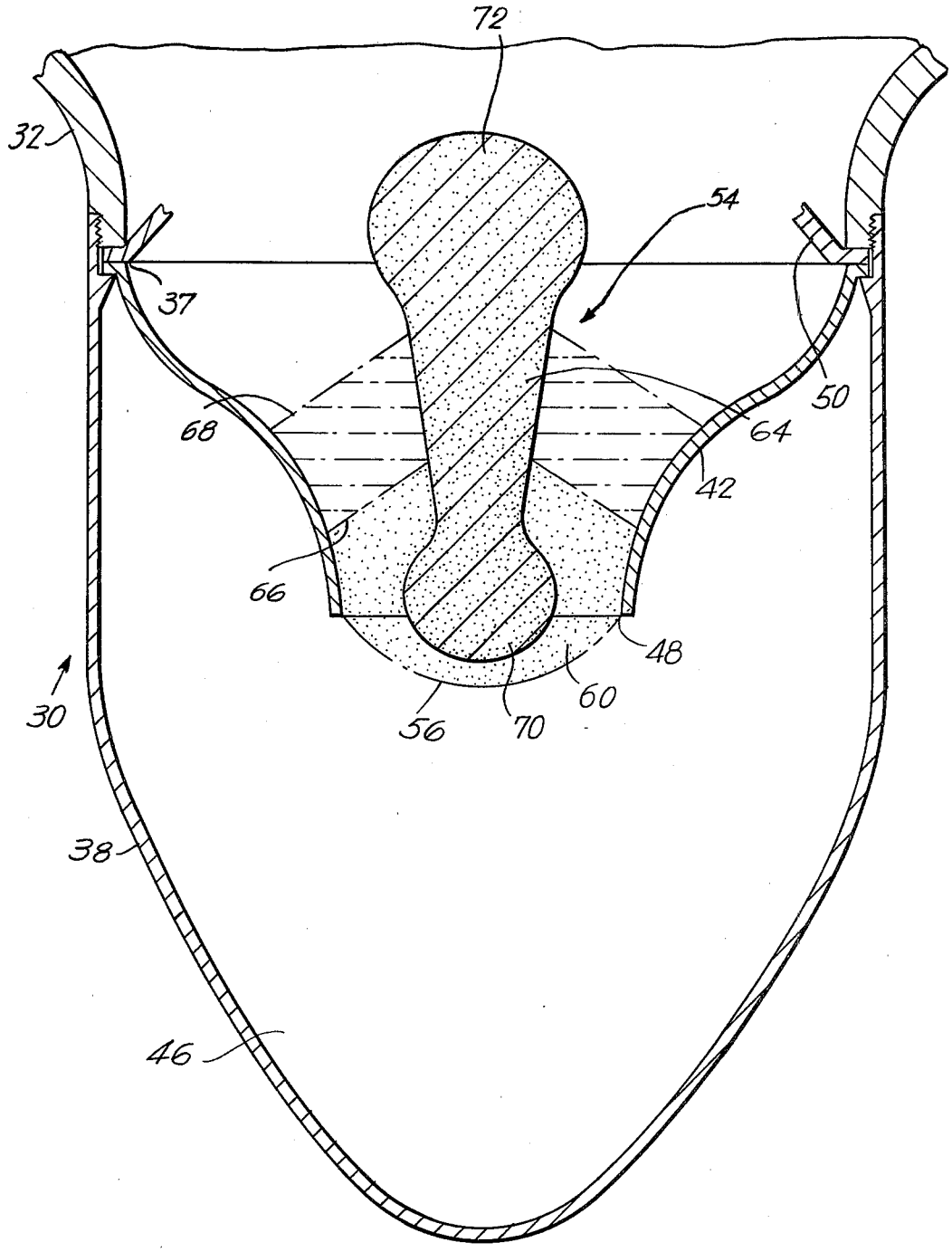
FIG. 4 is a cross section corresponding to FIG. 2 showing the formation of a reflected shock and its interaction with the jet.

Referring now to FIG. 4, as region 60 passes through opening 48, a reflected region 64 of multiple shock waves forms between the inside surface of shock-wave-reflecting member 42 and a portion 64 of jet 54. Region 62 of reflected shock waves is believed to develop a generally stationary forward edge 66 and a rear edge 68 which appears to propagate backwards toward base 37 of liner 50. Jet 54 which normally is propagated with central region 64 stretching forward as particle velocities increase in the forward direction, is modified to produce, for example, a forward region 70 having a different distribution of particle velocities therein than would otherwise be produced. The ability to thus control particle velocities provides the ability to shape the production and reach of jet 54 in a new fashion which may be useful in improving the penetration capability of shaped charge warhead 30.

A rear portion or slug 72 of jet 54 which consists of a slower moving portion of jet material may be either accelerated forward towards, or backward from, the target after interaction with the region 62 of reflected shock waves.

Due to the relatively large volume of air or other low density material in outer region 46 of frontal ogive 38, the above-described interaction between jet 54 and member 42 is not disturbed or interfered with by the presence of frontal ogive 38. Instead, the relatively large volume of outer region 46 permits compression of the gas or low density material therein to permit formation of jet 54.

The flow equations associated with jet 54 and flow region 62 have been evaluated using both Eulerian (DORF-9 Code) and Lagrangian (HEMP Code) finite difference computer programs. These computer programs are described in chapter 7 of "Dynamic Response of Materials to Intense-Impulsive Loading" edited by C. H. Chou and A. K. Hopkins, printed by Air Force Materials Laboratories, Library of Congress Card No. 73-6 00247. The numerical results show that, for a specific jet tip velocity and jet diameter, the magnitude of the impulsive loading in region 62 can be adjusted by using either a variety of low density materials within inner region 44, or by the particulate matter or vapor in region 60. In addition, the shape and material of shock-wave-reflecting member 42 and the size W of opening 48 can be adjusted to control the shapes of jet 54.

Figure 5A:
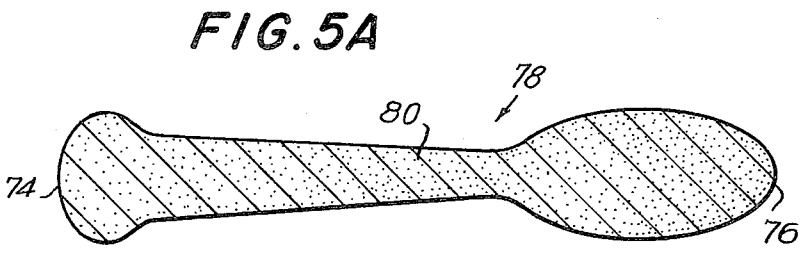
FIGS. 5A–5C are jet shapes which may be produced according to the teachings of the present invention.
Figure 5B:
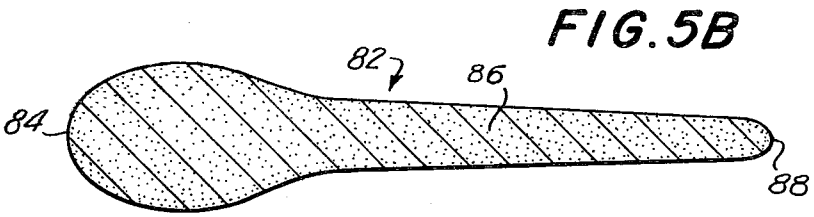
Figure 5C:
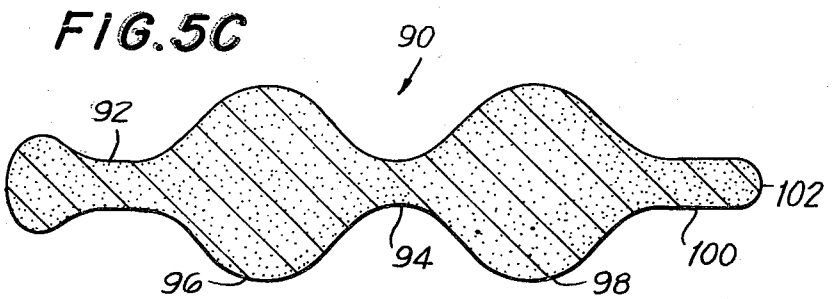

Referring now to FIGS. 5A–5C, a variety of shapes which may be produced using one or more shock-wave-reflecting members are shown. Jet 78 in FIG. 5A includes a rear portion 74, an intermediate portion 80 and a forward tip portion 76. Intermediate portion 80 is seen to reduce in thickness toward forward tip 76 indicating an increase in velocity with length until it joins the broader forward tip 76. Forward tip 76 is a region of constant velocity produced, for example, by shock wave interaction as previously described.

In FIG. 5B, a jet 82 has a relatively broad rear section 84 in which particle velocities are substantially constant and a stretching jet portion 86 of narrowing cross section to a tip 88. The transition between rear section 84 and stretching jet portion 86 may be controlled, for example, by a region of reflected shock wave interaction as previously described.

A jet 90 in FIG. 5C may be formed using regions of reflected shock wave interaction at more than one point along its length. A rear stretching jet portion 92 is separated from an intermediate stretching jet portion 94 by a first broader region 96 in which particles are decelerated with respect to rear stretching jet portion 92 and are travelling at, for example, a constant velocity. The particles are then accelerated into and along intermediate stretching jet portion 94 until they enter a second broader region 98 of decreased and/or constant jet velocity whereafter they enter and are accelerated into and along a forward stretching jet region 100 to a tip 102.

The preceding description has been based on the assumption that the shaped charge warhead is symmetrical about an axis. This should not be taken to exclude the possibility of applying the present invention to a shaped charge warhead which is symmetric about a plane of symmetry in which the resultant jet, instead of having a circular cross section, may have an elliptical or other shaped cross section.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A shaped charge warhead of the type having a concave cavity in front of an explosive for producing a jet of rapidly forward-moving particles preceded by a shock wave and a frontal ogive enclosing said cavity, comprising:

at least one shaped surface in said frontal ogive forward of said cavity dividing said frontal ogive into an inner region and an outer region;

said shaped surface having a central opening therein communicating said inner and outer regions; and the shape of said surface and the location and size of said opening being effective to produce regions of reflected shock which interact with said jet to modify at least one characteristic of said jet.

2. A shaped charge warhead according to claim 1; wherein said shaped surface is cured.

3. A shaped charge warhead according to claim 1; wherein said opening is symmetrical to a plane passing through an axis of said warhead.

4. A shaped charge warhead according to claim 1; wherein said opening is symmetrical to an axis of said warhead.

5. A shaped charge warhead according to claim 1; further comprising means for permitting removal and replacement of said surface from said front ogive without removing said explosive from said warhead whereby performance of said warhead can be easily modified.

6. A shaped charge warhead according to claim 1; wherein said at least one characteristic includes a speed of said particles in at least one portion of said jet.

7. A shaped charge warhead according to claim 1; wherein said at least one characteristic includes a thickness of said jet normal to an axis thereof in at least one portion of said jet.

8. A shaped charge warhead according to claim 7; wherein said at least one characteristic further includes a speed of said particles in said at least one portion of said jet.

9. A shaped charge warhead according to claim 1; further comprising a liner in said cavity, a coating on a forward surface of said liner, said coating being of a type which is effective to add at least one of gases and particles into said inner region upon impact thereon of said shock wave, said at least one of gases and particles being effective to influence said reflected shock.

10. A shaped charge warhead according to claim 1; further comprising a coating on at least a portion of said surface contiguous to said inner region, said coating being of a type which is effective to add at least one of gases and particles into said inner region impact thereon of said shock wave, said at least one of said gases and particles being effective to influence said reflected shock.

11. A shaped charge warhead according to claim 1; further comprising a low density material in said inner region.

12. A shaped charge warhead according to claim 11; wherein said low density material is a porous solid material.

13. A shaped charge warhead according to claim 11; wherein said low density material is a gas.

14. A shaped charge warhead comprising:

a casing;

a generally conical metallic liner closing a forward end of said casing, said liner forming an axially symmetric concave cavity in the forward end of said casing;

an explosive in said casing;

means for detonating said explosive at the rear end thereof;

a frontal ogive enclosing the forward end of said shaped charge warhead;

a shock-wave-reflecting surface in said frontal ogive dividing the volume in said frontal ogive into an inner region between said surface and said liner and a outer region between said surface and the inside of said frontal ogive;

an axially symmetrical hole in said surface communicating said inner and outer regions;

said warhead being effective when detonated to collapse said liner into a high-speed jet of particles which pass through said hole preceded by a bow shock wave; and said shock-wave-reflecting surface being effective to form a reflected shock region which modifies at least one characteristic of said jet.

* * * * *